US007604142B2

(12) United States Patent
Banik

(10) Patent No.: US 7,604,142 B2
(45) Date of Patent: Oct. 20, 2009

(54) CONTAINER SYSTEM

(75) Inventor: Joachim Banik, Oconomowoc, WI (US)

(73) Assignee: Rexam Beauty and Closures, Inc., Sussex, WI (US)

( * ) Notice: Subject to any disclaimer, the term of this patent is extended or adjusted under 35 U.S.C. 154(b) by 593 days.

(21) Appl. No.: 11/297,798

(22) Filed: Dec. 8, 2005

(65) Prior Publication Data

US 2007/0131680 A1 Jun. 14, 2007

(51) Int. Cl.
*B65D 43/16* (2006.01)
*B65D 43/22* (2006.01)
*B65D 43/24* (2006.01)
*B65D 6/28* (2006.01)

(52) U.S. Cl. ..... 220/4.22; 220/250; 220/829; 220/832; 220/827

(58) Field of Classification Search ..... 220/250, 220/4.24, 4.22, 4.23, 831, 832, 827, 829, 220/840; 16/280, 293, 296
See application file for complete search history.

(56) References Cited

U.S. PATENT DOCUMENTS

| | | | | | |
|---|---|---|---|---|---|
| 753,381 | A | | 3/1904 | Vom Eigen | |
| 911,949 | A | * | 2/1909 | Day | 16/293 |
| 1,165,894 | A | | 12/1915 | Negraval | |
| 1,364,594 | A | | 1/1921 | Thomas | |
| 1,740,866 | A | | 12/1929 | McBarron | |
| 2,105,071 | A | * | 1/1938 | Bowers | 49/386 |
| RE20,986 | E | * | 1/1939 | Kreisler | 220/326 |
| 2,295,494 | A | * | 9/1942 | Valentine | 220/829 |
| 2,303,147 | A | * | 11/1942 | Tinnerman | 220/827 |
| 2,435,272 | A | * | 2/1948 | Graham | 220/827 |
| 2,580,310 | A | | 12/1951 | Magnenat | |
| 2,634,018 | A | | 4/1953 | Mageau, Jr. | |
| 2,654,118 | A | * | 10/1953 | Scott | 16/293 |
| 2,702,651 | A | | 2/1955 | Graham | |
| 2,706,307 | A | * | 4/1955 | Anderson | 16/293 |
| 2,905,356 | A | | 9/1959 | Jerome | |
| 4,114,236 | A | * | 9/1978 | Vandervort | 16/335 |
| 4,477,941 | A | | 10/1984 | Gregg | |
| 4,670,809 | A | * | 6/1987 | Teuber | 242/347.1 |
| 4,693,392 | A | * | 9/1987 | Contreras, Sr. | 220/827 |
| 4,891,862 | A | | 1/1990 | Holan | |
| 4,932,101 | A | | 6/1990 | Lualdi | |
| 4,979,634 | A | | 12/1990 | Begley | |
| 4,984,706 | A | * | 1/1991 | Cadwell et al. | 312/223.2 |
| 5,098,150 | A | | 3/1992 | Smith et al. | |
| 5,111,503 | A | | 5/1992 | Takagi | |

(Continued)

FOREIGN PATENT DOCUMENTS

JP 4-319302 A 11/1992

*Primary Examiner*—Anthony D Stashick
*Assistant Examiner*—Niki M Eloshway
(74) *Attorney, Agent, or Firm*—Foley & Lardner LLP

(57) ABSTRACT

A container for storing one or more articles (e.g., cosmetic substances, accessories, applicators, etc.) is provided. The container includes a base, a cover pivotally coupled to the base about a hinge, a resilient bar supported at one of the base and the cover, and a first cam surface supported at the other of the base and the cover. The first cam surface is configured to engage the resilient bar when the cover has moved a predetermined angle relative to the base. The resilient bar acting on the first cam surface moves the cover to a closed position. According to an exemplary embodiment, the resilient bar and/or the first cam surface is substantially concealed within the container.

20 Claims, 13 Drawing Sheets

U.S. PATENT DOCUMENTS

| | | | | |
|---|---|---|---|---|
| 5,517,724 | A | 5/1996 | Beneke | |
| 5,604,956 | A | 2/1997 | Grass | |
| 6,244,647 | B1 | 6/2001 | Allison | |
| 6,352,295 | B1 | 3/2002 | Leitner | |
| 6,530,498 | B1 | 3/2003 | Ovadia | |
| 7,258,386 | B2 * | 8/2007 | Leitner | 296/97.22 |
| 2003/0173369 | A1 * | 9/2003 | Nikolaus et al. | 220/830 |

* cited by examiner

CONTAINER SYSTEM

BACKGROUND

The present application relates generally to the field of storage or container systems for storing one or more articles (e.g., cosmetic substances, applicators, accessories, etc.). The present application more specifically relates to systems or mechanisms (e.g., closer mechanisms, latch mechanisms, etc.) configured to move a container system to a closed or stowed position or retain a container system in such a position.

It is generally known to provide a container used for storing one or more cosmetic articles (e.g., cosmetic substances, applicators, accessories, etc.) or other articles such as tissues (e.g., wet, dry, etc.), jewelry, spectacles, foodstuff, or the like. Such known containers often include a base and a cover arranged in clamshell-like configuration (i.e., the cover is pivotally coupled to the base about a hinge). The base generally defines a cavity configured to store the one or more articles, while the cover is movably coupled to the base and configured to overlay and/or seal this cavity. Such known containers also typically include a latch mechanism to facilitate engaging and disengaging the cover and the base such that the cover will be secured to the base until the latch mechanism is selectively actuated by a user. Known latch mechanisms (e.g., push-buttons, clasps, levers, switches, handles, etc.) are generally provided on an outer surface of the container and located on a side opposite the hinge. Such a latch mechanism may interfere with the aesthetics of the container (e.g., by disrupting the continuity of the container's profile, etc.). In addition, a user may find it difficult to actuate such a latch mechanism. Further, such a latch mechanism may be expensive to manufacture or may occupy a substantial amount of space within the container thereby limiting the amount of space available for storing an article.

Thus there is a need for a container having a closer or latch mechanism that does not substantially interfere with the aesthetics of a container. There is also a need for a container having a closer or latch mechanism that is substantially concealed from the view of a user when the container is in an open position and/or when the container is in a closed position. There is further a need for a container having a nonintrusive closer or latch mechanism that can be installed efficiently via an automated assembly process. Accordingly, it would be desirable to provide a container capable of accomplishing any one or more of these or other needs.

SUMMARY

An exemplary embodiment relates to a container. The container includes a base, a cover coupled to the base about a hinge, a resilient bar supported at one of the base and the cover, and a first cam surface supported at the other one of the base and the cover. The first cam surface is configured to engage the resilient bar when the cover has moved a predetermined angle relative to the base. The resilient bar acting on the first cam surface moves the cover to a closed position.

Another exemplary embodiment relates to a cosmetic container. The cosmetic container includes a base, a deck supported by the base and defining at least one cavity for supporting a cosmetic article, and a cover coupled to the base about a hinge. The cover is configured to move between an open position and a closed position relative to the base. The cosmetic compact further includes a resilient member supported at one of the base and the cover and a first cam surface configured to engage the resilient member for moving the cover to the closed position. The deck conceals the resilient member within an interior of the container when the cover is in the open position.

Another exemplary embodiment relates to a cosmetic compact. The cosmetic compact includes a container means, a cover means pivotable relative to the container means between an open position and a closed position, and a deck means for supporting a cosmetic article. The deck means is supported by the container means. The cosmetic compact further includes a biasing means supported at one of the container means and cover means and cam means supported at the other one of the container means and cover means. The cams means is configured to engage the biasing means for moving the cover means between the open position and the closed position. The deck means substantially conceals the biasing means when the cover means is in the open position.

DETAILED DESCRIPTION

Referring generally to all the FIGURES, a storage or container system is shown according to various exemplary embodiments. The container system (shown in FIGS. 1 through 8*c* as a container 100 and in FIGS. 9 through 12 as a container 1100) generally comprises a first portion (e.g., lid, closure, top, etc.), referred to generally herein as a cover portion, and a second portion (e.g., bottom, receptacle, etc.), referred to generally herein as a base portion. The cover portion and base portion cooperate to provide a receptacle suitable for holding one or more articles (e.g., cosmetic substances, cosmetic applicators or tools, wipes or tissues, etc.).

Figure 1:
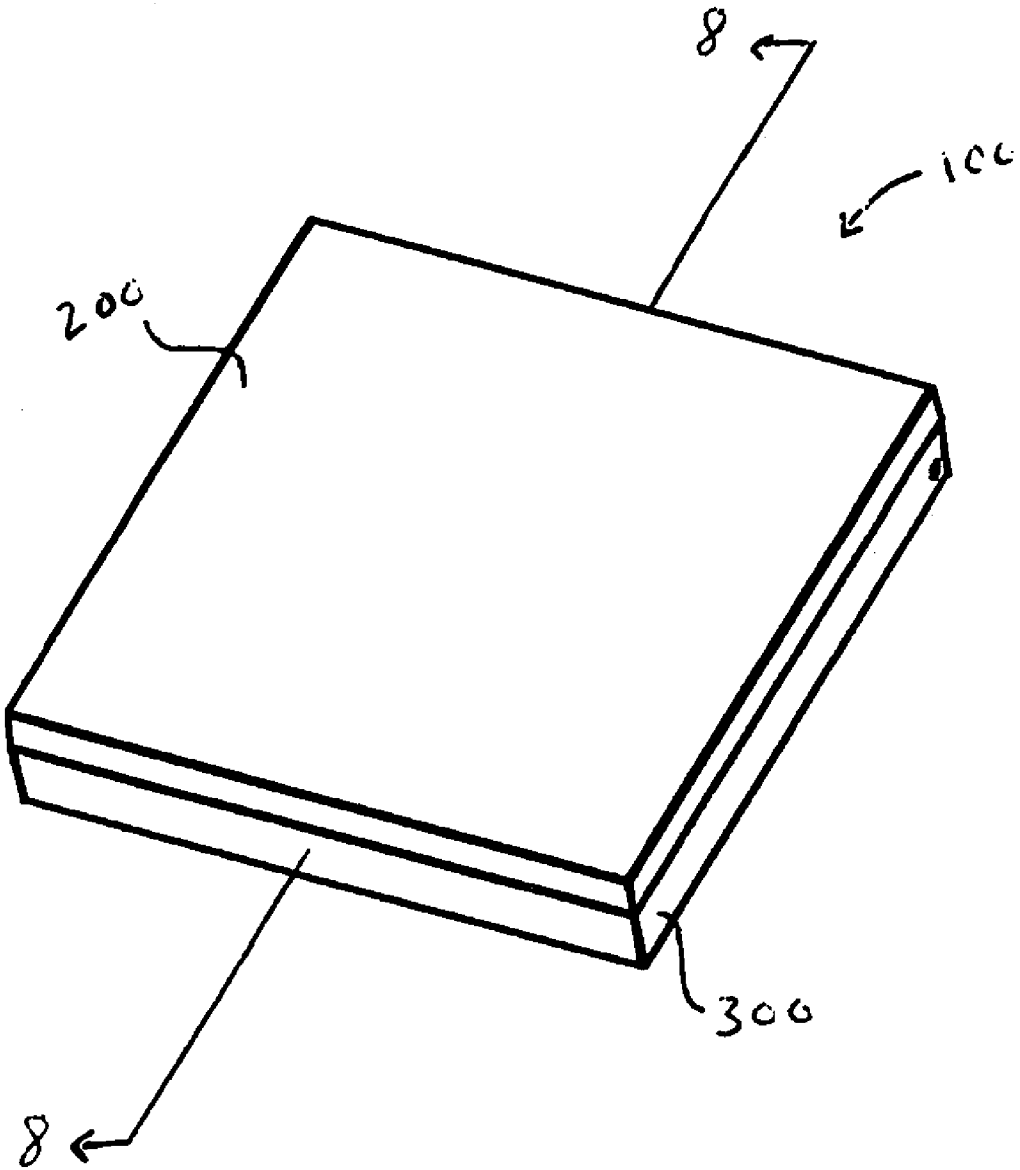
FIG. 1 is a top perspective view of a schematic drawing of a container system according to one exemplary embodiment shown in a closed position.
Figure 2:
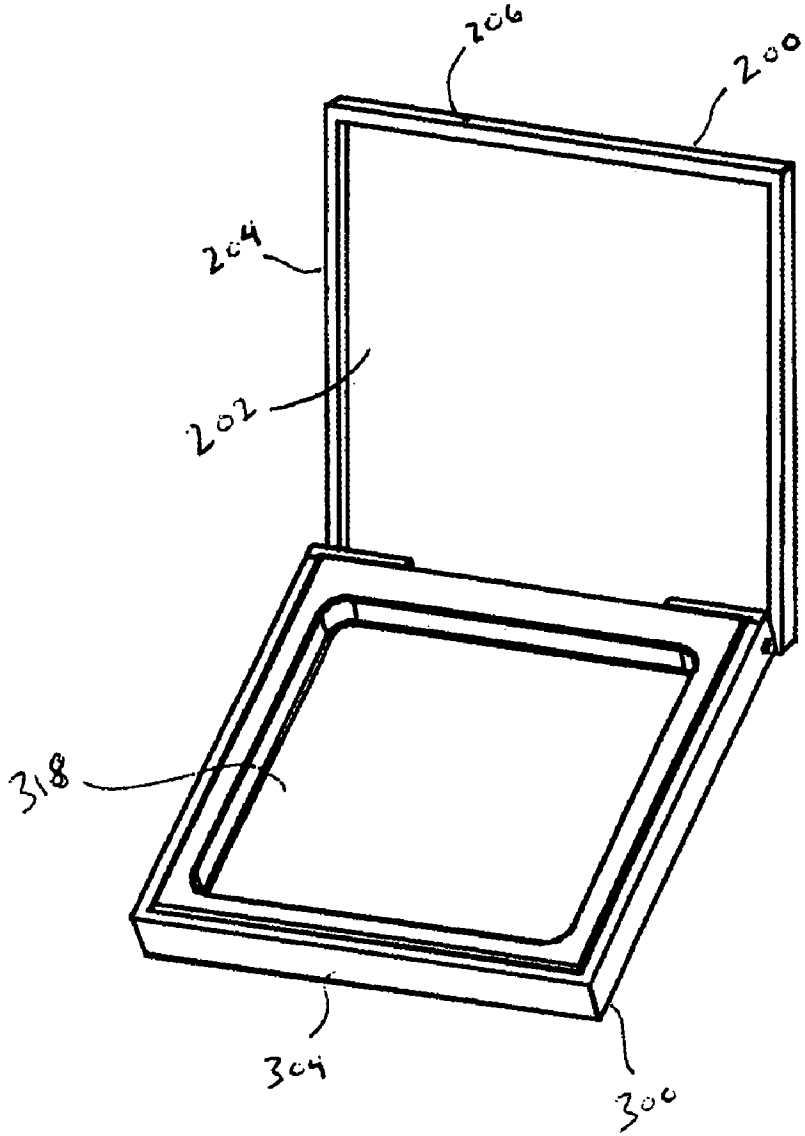
FIG. 2 is a top perspective view of a schematic drawing of the container system of FIG. 1 shown in an open position.
Figure 9:
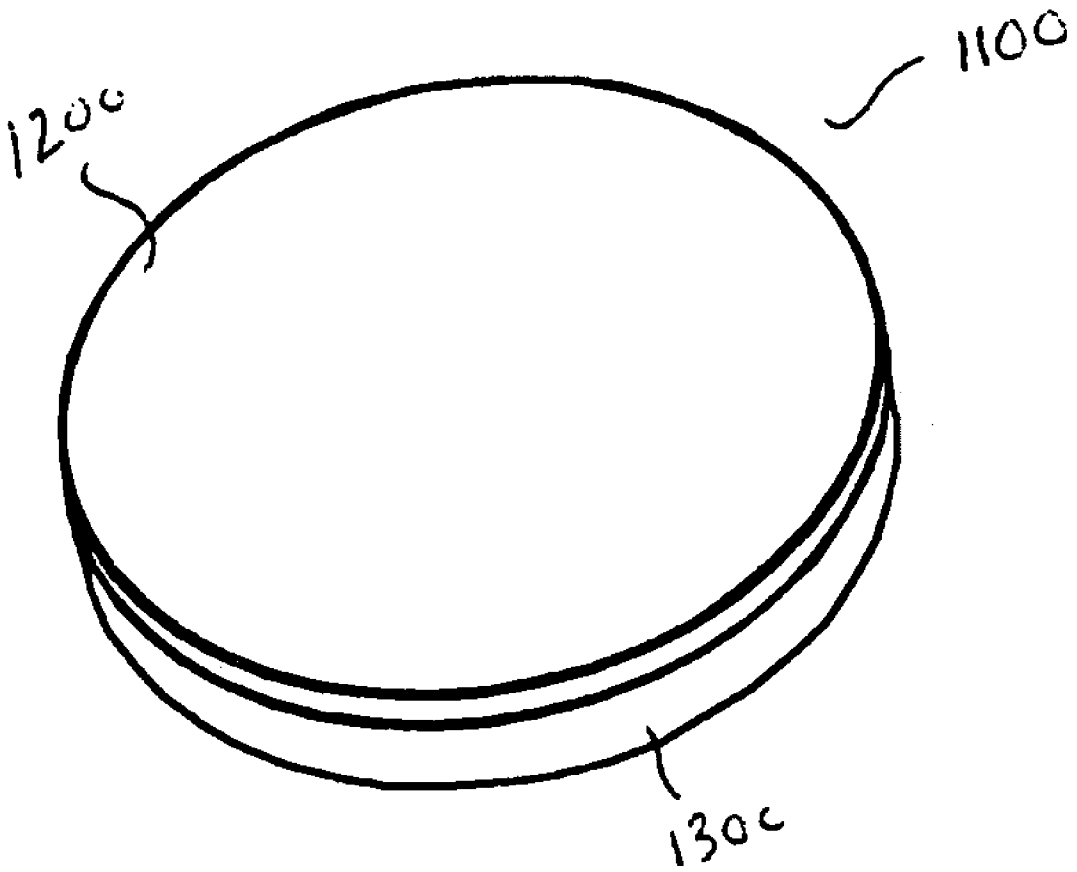
FIG. 9 is a top perspective view of a schematic drawing of a container system according to another exemplary embodiment shown in a closed position.
Figure 10:
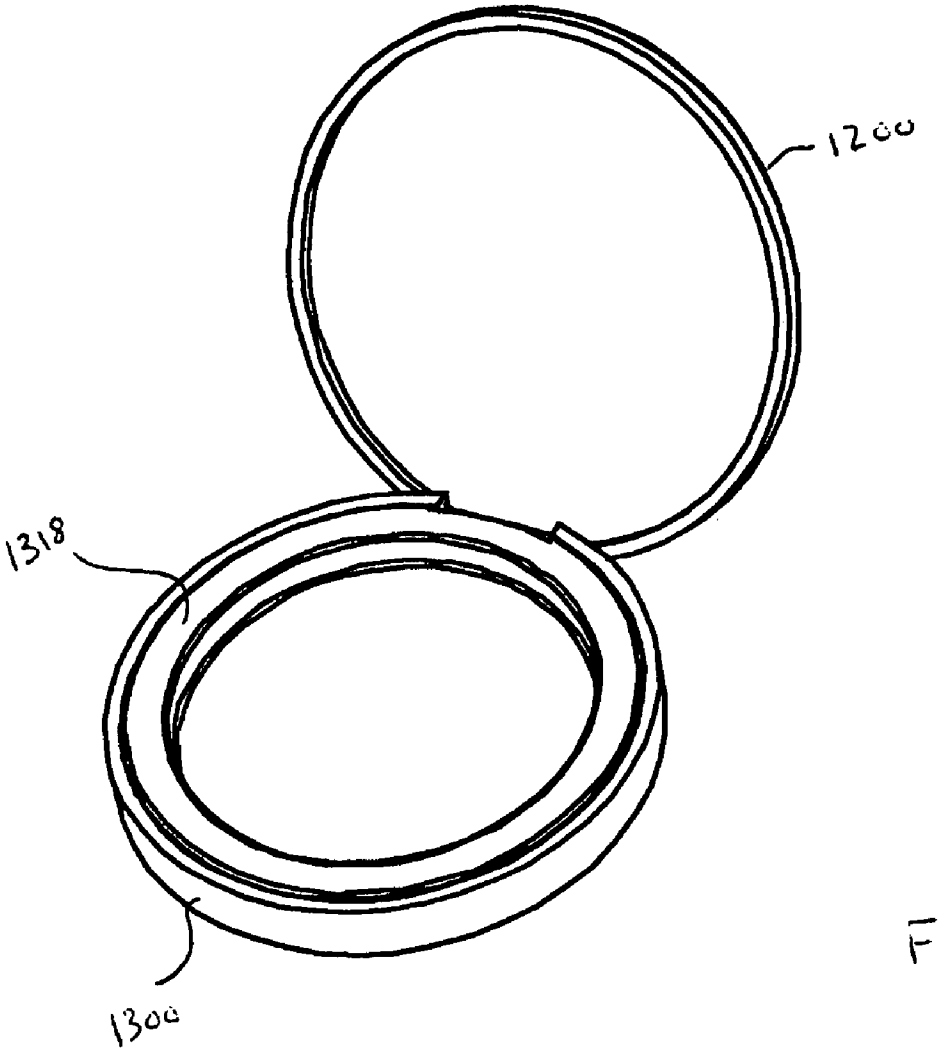
FIG. 10 is a top perspective view of a schematic drawing of the container system of FIG. 9 shown in an open position.
Figure 11:
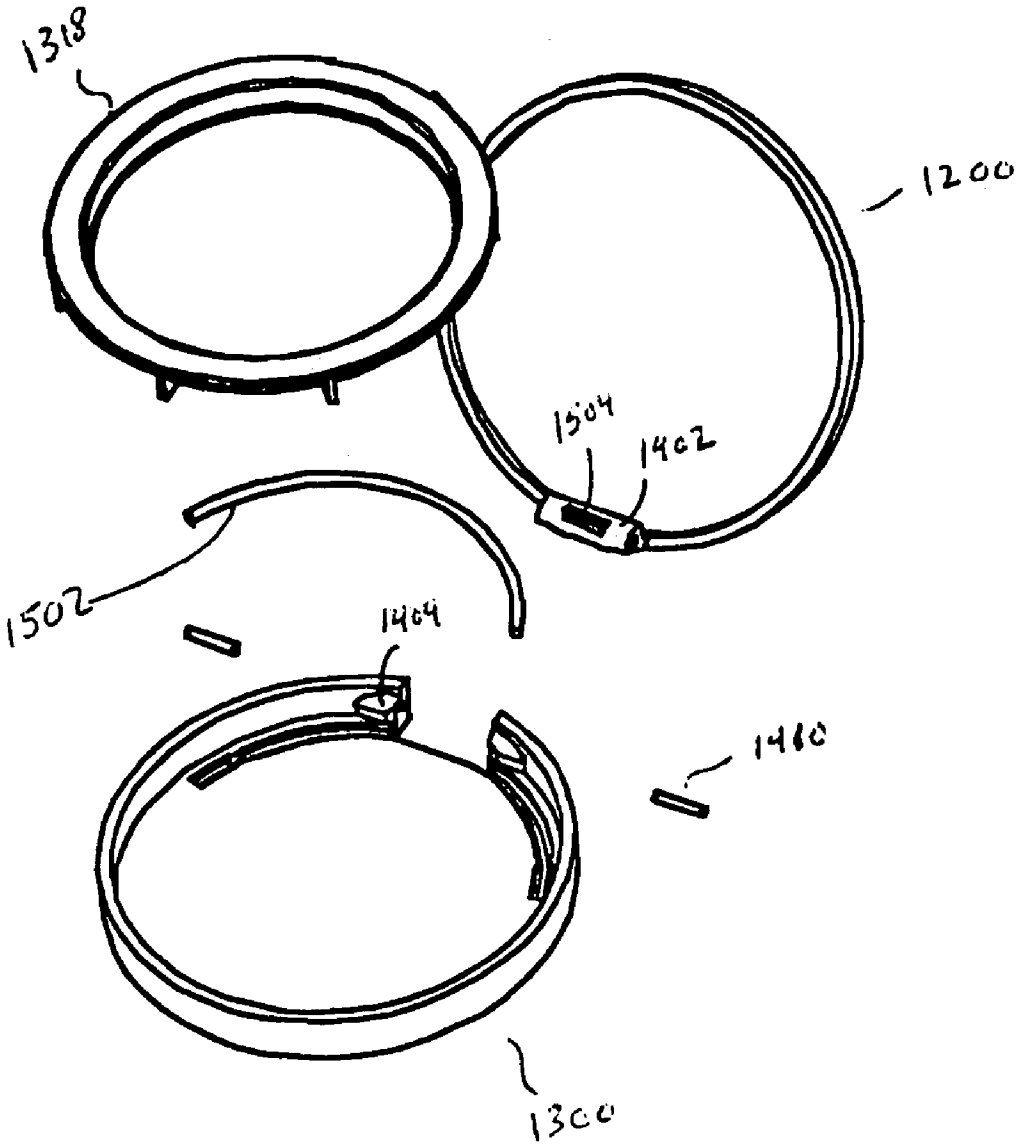
FIG. 11 is an exploded top perspective view of a schematic drawing of the container system of FIG. 9.
Figure 12:
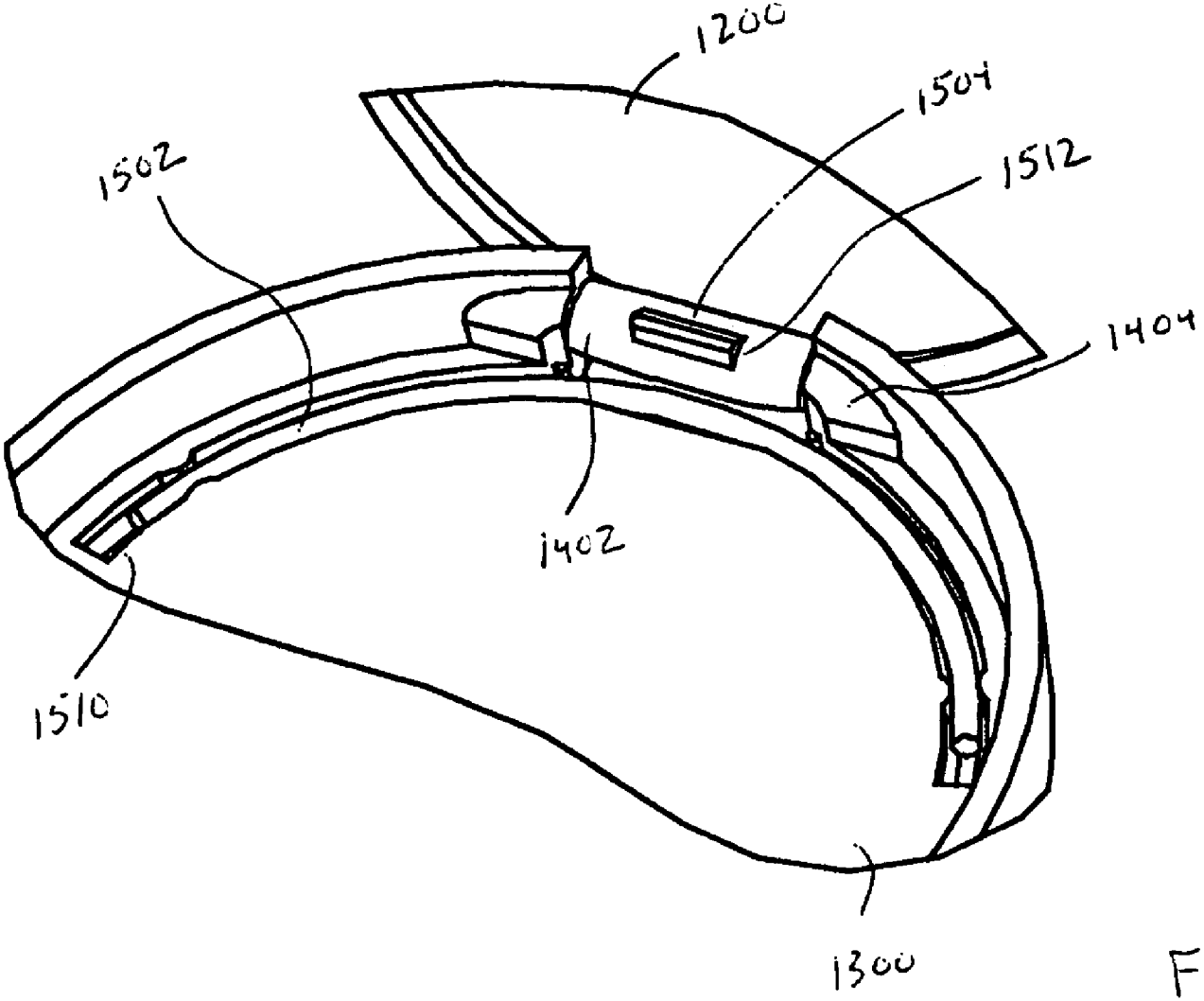
FIG. 12 is a more detailed perspective view of a schematic drawing of the container of FIG. 9.

As illustrated in the FIGURES, the cover portion is coupled to the base portion about a hinge such that a user may selectively move (e.g., pivot, rotate, etc.) the cover portion relative to the base portion between a first or closed position (wherein the one or more articles provided therein is concealed as, shown in FIGS. 1 and 9) and a second or open position (wherein the one or more articles supported therein is accessible to a user or otherwise revealed as shown in FIGS. 2 and 10). To assist in moving the cover portion from the open position to the closed position and/or to secure (e.g., latch, lock, retain, etc.), or assist in securing, the cover portion relative to the base portion when in the closed position, a closer mechanism is provided.

According to an exemplary embodiment, the closer mechanism functions to move the cover portion into the closed position during a closing operation after the cover portion has pivoted a predetermined angle relative to the base portion. As detailed below, the elements or components of the closer mechanism are substantially concealed (e.g., hidden, etc.) within the container system when the container system is in the closed position and/or the open position.

As further illustrated in the FIGURES, the closer mechanism generally comprises a resilient bar (e.g., biasing member, spring, spring wire, spring rod, pin, etc.) and one or more cam surfaces (e.g., a first or closing cam surface, a second or opening cam surface, etc.). The resilient bar is supported at one of the cover portion and the base portion, while the one or more cam surfaces are supported at the other of the cover portion and the base portion. The one or more cam surfaces are configured to engage (e.g., deflect, etc.) the resilient bar as the cover portion is moving between the open position and the closed position and/or between the closed position and the open position for assisting in the closing and/or opening of the cover portion respectively. Once in the open position and/or in the closed position, the one or more cam surfaces, acting on the resilient bar, may assist in retaining the cover portion in such a position until a force sufficient to overcome the force exerted by the resilient bar is applied to the cover portion.

Such a closer mechanism may advantageously improve the aesthetics of the container system by allowing the container to achieve a clean and/or elegant appearance (e.g., no distracting visible latch element such as push-buttons, clasps, levers, handles, etc.) when the container is in the closed position and/or open position. Such a closer mechanism may also simplify the closing and/or opening operation of the container system. Such a closer mechanism may also advantageously occupy a minimal amount of space within the container system thereby allowing the container system to support an increased amount of articles.

It should be noted at the outset that while the container system described herein will be described as a container configured to hold a cosmetic article, and particularly a cosmetic substance, the present invention has broad applicability to a variety of container systems. For example, the present invention may be suitable for with, but not limited to, container systems for holding jewelry, spectacles, foodstuff, or any other container system wherein it would be desirable to provide a relatively nonintrusive means for moving a cover portion into a closed position. Further, while the container system described herein is preferably sized to fit conveniently into a user's bag, purse, pocket, etc., the present invention is suitable for use with larger container systems.

Referring to FIGS. 1 through 8*c* in detail, and initially to FIG. 1, the container 100 is shown according to a first exemplary embodiment. The container 100 is shown as being a substantially rectangular (e.g., square, etc.) container comprising a cover portion 200 and a base portion 300. The container 100 is configured as a cosmetic container or compact (e.g., makeup case, etc.) suitable for holding a cosmetic substance (e.g., pressed powder, loose powder, lip gloss, etc.) and/or a cosmetic accessory, tool or applicator (e.g., pencil, brush, tweezers, cloth, etc.). The container 100 is sized to conveniently fit into relatively small spaces (e.g., purses, handbags, pockets, briefcases, etc.). For example, the container 100 (when closed) preferably has a width between approximately 1 inch and approximately 6 inches, a length between approximately 1 inch and approximately 6 inches, and a height or thickness between approximately 0.25 inches and approximately 2 inches. According to various alternative embodiments, the container 100 may be sized larger or smaller then these dimensions depending on various design criteria.

According to an exemplary embodiment, the cover portion 200 and the base portion 300 are formed of resins (plastic or otherwise), including, but not limited to, injection moldable thermoplastic resin, such as acrylonitrile butadiene styrene (ABS), styrene-acrylonitrile copolymer (SAN), polypropylene (PP), polyethylene (PE), polyvinylchloride (PVC), or thermo-plastic elastomers (TPE). According to various alternative embodiments, other suitable materials or combinations materials may be used to form the cover portion 200 and the base portion 300 (e.g., metals, bimetals, composites, wood, etc.).

Figure 3:
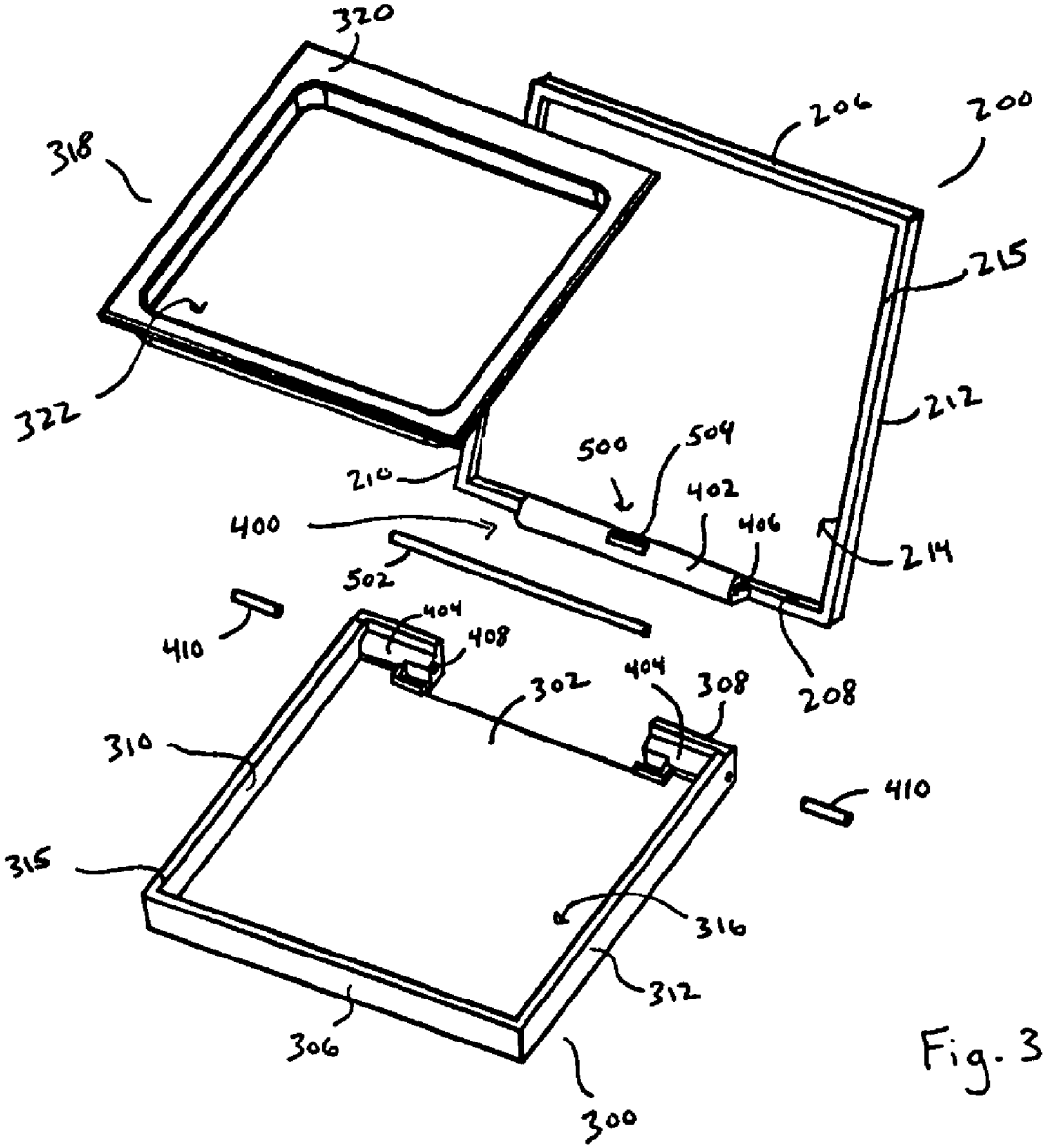
FIG. 3 is an exploded top perspective view of a schematic drawing of the container system of FIG. 1.

Referring to FIGS. 1 through 3, the cover portion 200 is shown as having an end wall 202 (e.g., platform, top, top surface, etc.) and a peripheral side wall 204 (skirt, peripheral surface, etc.) extending downward therefrom at an orientation that is generally perpendicular to the end wall 202. The peripheral side wall 204 is generally rectangular in shape and at least partially defines an outer periphery of the container 100. The peripheral side wall 204 is formed of a front wall 206, a rear wall 208, and side walls 210 and 212 which cooperate to form a continuous sidewall. According to various alternative embodiments, the peripheral side wall 204 may comprise one or more sections providing for a discontinuous or intermittent peripheral side wall. The peripheral side wall 204 is further shown as comprising a bottom face or surface 215 (shown in FIG. 3) configured to interface (e.g., mate with, engage, contact, etc.) a corresponding structure on the base portion 300. According to various alternative embodiments, the peripheral side wall 204 may be adapted to fit over and/or inside a structure surrounding an open end of the base portion 300 such as a flange. According to further alternative embodiments, the peripheral side wall 204 may be eliminated depending on the configuration of the base portion 300.

The cover portion 200 further includes the end wall 202 that is orientated generally perpendicular to a central axis of the peripheral side wall 204. According to an exemplary embodiment, the end wall 202 and the peripheral side wall 204 are integrally formed as a single unitary body in a single mold by an injection molding operation to form the cover portion 200. According to various alternative embodiments, the end wall section may be coupled to the side wall section in any suitable manner (e.g., snap-fit, welding, etc.). Depending on various design criteria, the profile of the end wall 202 may vary. According to the embodiment illustrated, the end wall 202 is a substantially planar or flat surface. According to various alternative embodiments, the end wall 202 may include portions that are convex, concave, stepped, angled, sloped, etc.

The cover portion 200 defines a cavity 214 with the end wall 202 and the peripheral side wall 204. According to an exemplary embodiment, the cavity 214 is sized to receive an accessory, such a mirror (not shown), coupled to the underside or inner surface of the end wall 202. The mirror may be coupled to the underside of the end wall 202 using any of variety of suitable techniques (e.g., mechanical fasteners, adhesives, welding, etc.). According to another exemplary embodiment, the cavity 214 may be sized to receive an applicator (not shown) when the cover portion 200 is in the closed position that may be useful in applying a cosmetic substance stored within the base portion 300. For example, the cavity 214 may be sized to hold a cloth, sponge, pad, or the like suitable for applying a cosmetic substance (e.g., pressed powder, etc.).

Referring to FIGS. 1 through 5, a base portion 300 of the container 100 is shown according to an exemplary embodiment. The base portion 300 has an end wall 302 (e.g., platform, bottom, bottom surface, etc.) and a peripheral side wall 304 extending upward therefrom at an orientation that is generally perpendicular to the end wall section 302. The peripheral side wall 304 is generally rectangular in shape and at least partially defines an outer periphery of the container 100. The peripheral side wall 304 is formed of a front wall 306, a rear wall 308, and side walls 310 and 312 that form an essentially square configuration. The peripheral side wall 304 may be substantially continuous (as shown), or alternatively, may comprises intermittent sections. The peripheral side wall 304 is further shown as comprising a top face or surface 315 (shown in FIG. 2) configured to interface (e.g., mate with, etc.) a corresponding structure on the cover portion 200 (e.g., the bottom surface 215, etc.). According to various alternative embodiments, the peripheral side wall 304 may be adapted to fit over and/or inside the cover portion 200. According to further alternative embodiments, the peripheral side wall 204 may be eliminated depending on the configuration of the cover portion 200.

The base portion 300 further includes the end wall 302 that is orientated generally perpendicular to a central axis of the peripheral side wall 304. According to one exemplary embodiment, the end wall 302 and the peripheral side wall 304 are integrally formed as a single unitary body in a single mold by an injection molding operation to form the base portion 300. According to various alternative embodiments, the end wall section may be coupled to the side wall section in any suitable manner (e.g., snap-fit, welding, etc.). Depending on various design criteria, the profile of the end wall 302 may vary. According to the embodiment, the end wall 302 is a substantially planar or flat surface. According to various alternative embodiments, the end wall 202 may include portions that are convex, concave, stepped, angled, sloped, etc.

The peripheral side wall 304 and the end wall 302 cooperate to define an aperture 316 (e.g., cavity, receptacle, etc.) suitable for supporting a cosmetic article or for receiving a pan or deck that is suitable for supporting a cosmetic article. The size and shape of the aperture 316 may vary depending on a number of design criteria. According to an exemplary embodiment, the aperture 316 has a volume between approximately 1.0 cubic inch and approximately 8 cubic inches. According to various alternative embodiments, the aperture 316 may have a volume greater than or less than the range provided. Limiting the volume of the aperture 316 allows the overall size of the container 100 to be minimized, thereby allowing the container 100 to be conveniently carried or stowed in relatively size restricted areas (e.g., pockets, purses, backpacks, etc.) by the user. According various alternative embodiments, the aperture 316 may be divided into two or more compartments (e.g., storage wells, etc.) for separating multiple cosmetic articles.

Referring to FIG. 3, the aperture 316 is configured to receive an insert (e.g., storage well, pan, etc.), shown a deck 318. The deck 318 includes a top surface 320 which defines a cavity 322 suitable for supporting a cosmetic article. While the deck 318 is shown as having a single cavity, according to various alternative embodiments, the deck 318 may be divided into a plurality of cavities or storage wells for supporting more than one cosmetic article. The deck 318 may be coupled within the aperture 316 using any of a variety of suitable techniques (e.g., press-fit, snap-fit, adhesives, welding, etc.). According to an exemplary embodiment, the deck 318 is intended to be permanently coupled to the base portion 300. According to various exemplary embodiments, the deck 318 may be detachably coupled to the base portion 300. Detachably coupling the deck 318 to the base portion 300 may allow a user to selectively refill or replace the deck 318 when desired (e.g., when a cosmetic substance has be depleted, etc.).

The cover portion 200 is pivotally coupled to the base portion 300 about a hinge, shown as a hinge mechanism 400. The hinge mechanism 400 functions to allow the cover portion 200 to be pivoted or rotated relative to the base portion between the closed position (shown in FIG. 1) and the open position (shown in FIG. 2). Any of a variety of known or otherwise suitable hinges may be used to pivotally couple the cover portion 200 to the base portion 300. According to an exemplary embodiment, the hinge mechanism 400 generally comprises a first hinge portion (e.g., knuckle, loop, joint, node, curl, etc.), shown in FIG. 3 as a first sleeve 402, supported at the cover portion 200 and a second hinge portion, shown as a second sleeve 404, supported at the base portion 300. The first sleeve 402 and the second sleeve 404 define longitudinal bores 406 and 408 respectively. Pivot rods or pins 410 are inserted within the bores 406 and 408 to support the cover portion 200 relative to the base portion 300 and to define a rotational axis about which the cover portion 200 rotates relative to the base portion 300.

Referring further to FIG. 3, the first sleeve 402 and the second sleeve 404 are shown as being integrally formed with the cover portion 200 and the base portion respectively as a one-piece unitary body. According to an exemplary embodiment, the first sleeve 402 and the second sleeve 404 are provided at a rear portion of the container 100. For example, FIG. 3 shows the first sleeve 402 extending downward from the rear wall 208 of the cover portion 200 and the second sleeve 404 extending upward from the rear wall 308 of the base portion 300. According to various alternative embodiments, the first and second hinge portions may be provided as separate components that are coupled to the cover portion and the base portion using a suitable coupling technique (e.g., mechanical fasteners, welding, adhesives, etc.). According to further alternative embodiments, the cover portion 200 and the base portion 300 may be integrally formed as a one-piece body with a living hinge or other equivalent coupling mechanism pivotally coupling the cover portion 200 to the base portion 300.

To assist in the closing operation of the container 100 (i.e., the moving of the cover portion 200 from the open position to the closed position), and/or to secure the cover portion 200 relative to the base portion 300 when in the closed position, the closer mechanism 500 is provided. Still referring to FIG. 3, the closer mechanism 500 generally comprises a resilient bar (e.g., biasing member, spring, spring wire, rod, pin, etc.), shown as a spring element 502, and a first cam surface 504. The spring element 502 is supported at one of the cover portion 200 and the base portion 300, while the first cam surface 504 is supported at the other of the cover portion 200 and the base portion 300. The first cam surface 504 is configured to engage the spring element 502 when the cover portion 200 has pivoted a predetermined angle relative to the base portion 300. The spring element 502 acting on the first cam surface 504 creates a closing torque on the cover portion 200 thereby causing the cover portion 200 to move towards the base portion 300.

According to an exemplary embodiment, the spring element 502 is a substantially straight member having a first end 506 and a second end 508. The spring element 502 is shown as being supported by the base portion 300 adjacent to the rear wall 308 and the second sleeve 404 of the hinge mechanism 400. The first end 506 and the second end 508 are secured so that a portion of the spring element 502 between the first end 506 and the second end 508 will deflect when engaged by the first cam surface 204. According to the embodiment illustrated, a pair of channels 510 (e.g., grooves, recesses, etc.) defined by the base portion 300 are configure to receive the first end 506 and the second end 508. The channels 510 are configured to secure (e.g., cradle, support, latch, etc.) the first end 506 and the second end 508.

According to an exemplary embodiment, the spring element 502 is formed of metal. According to various alternative embodiments, the spring element 502 may be formed of any of a variety of suitable materials. For example, the spring element 502 may be formed of a resin or plastic, composites, spring wire, etc.

Insertion of the spring element 502 into the channels 510 at least partially restricts the first end 506 and the second end 508 from moving in a direction toward the front wall 306 of base portion 300 and substantially perpendicular to the rotational axis of the hinge mechanism 400 when the spring element 502 is engaged by the first cam surface 504. According to an exemplary embodiment, the spring element 502 is coupled to the base portion 300 by moving the spring element 502 from a position above the base portion 300 downward in a vertical direction into the channels 510. Such a configuration makes it relatively easy to have the spring element 502 installed on the base portion 300 using an automated assembly process.

Figure 4:
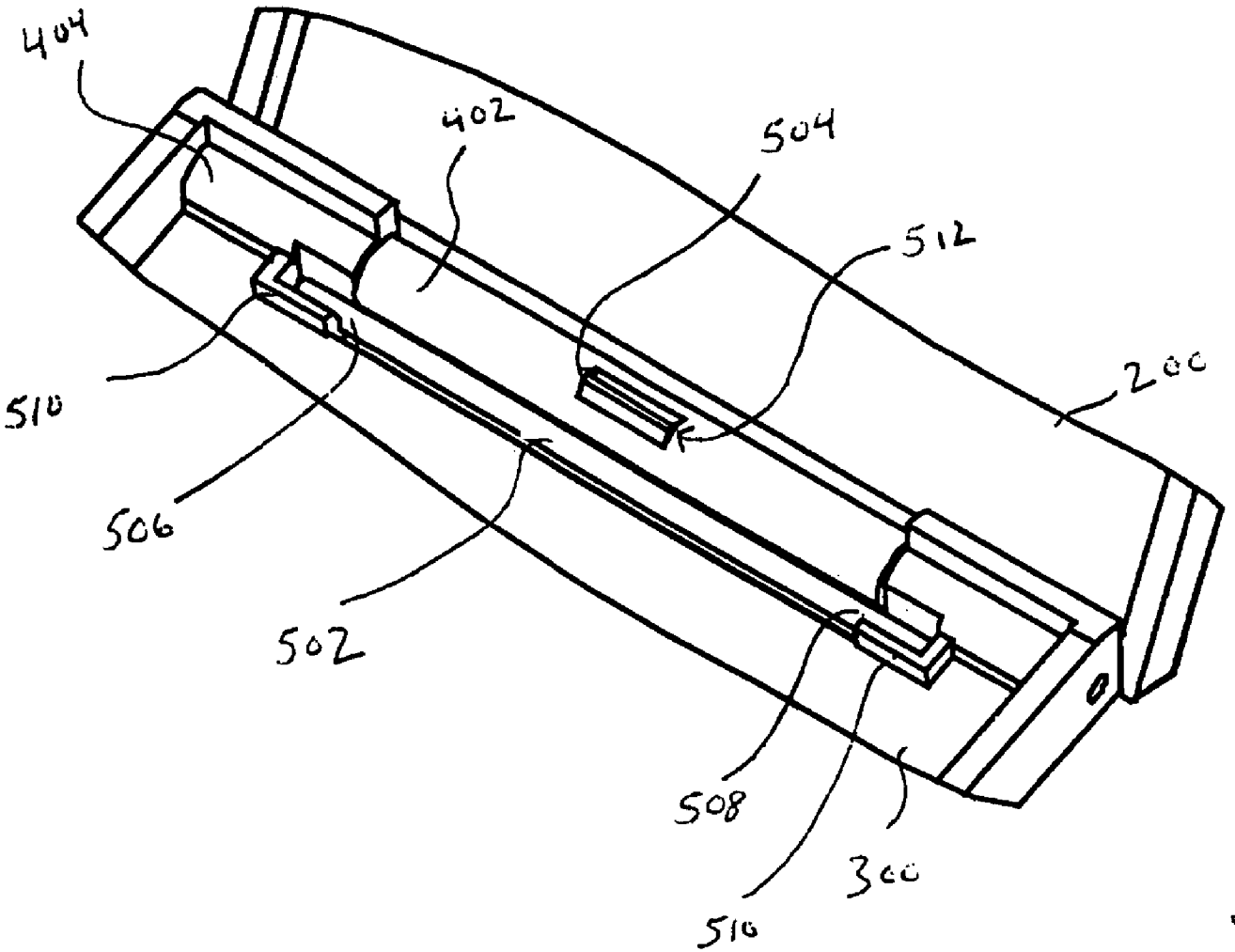
FIG. 4 is a more detailed top perspective view of a schematic drawing of the container of FIG. 1.
Figures 5, 6:
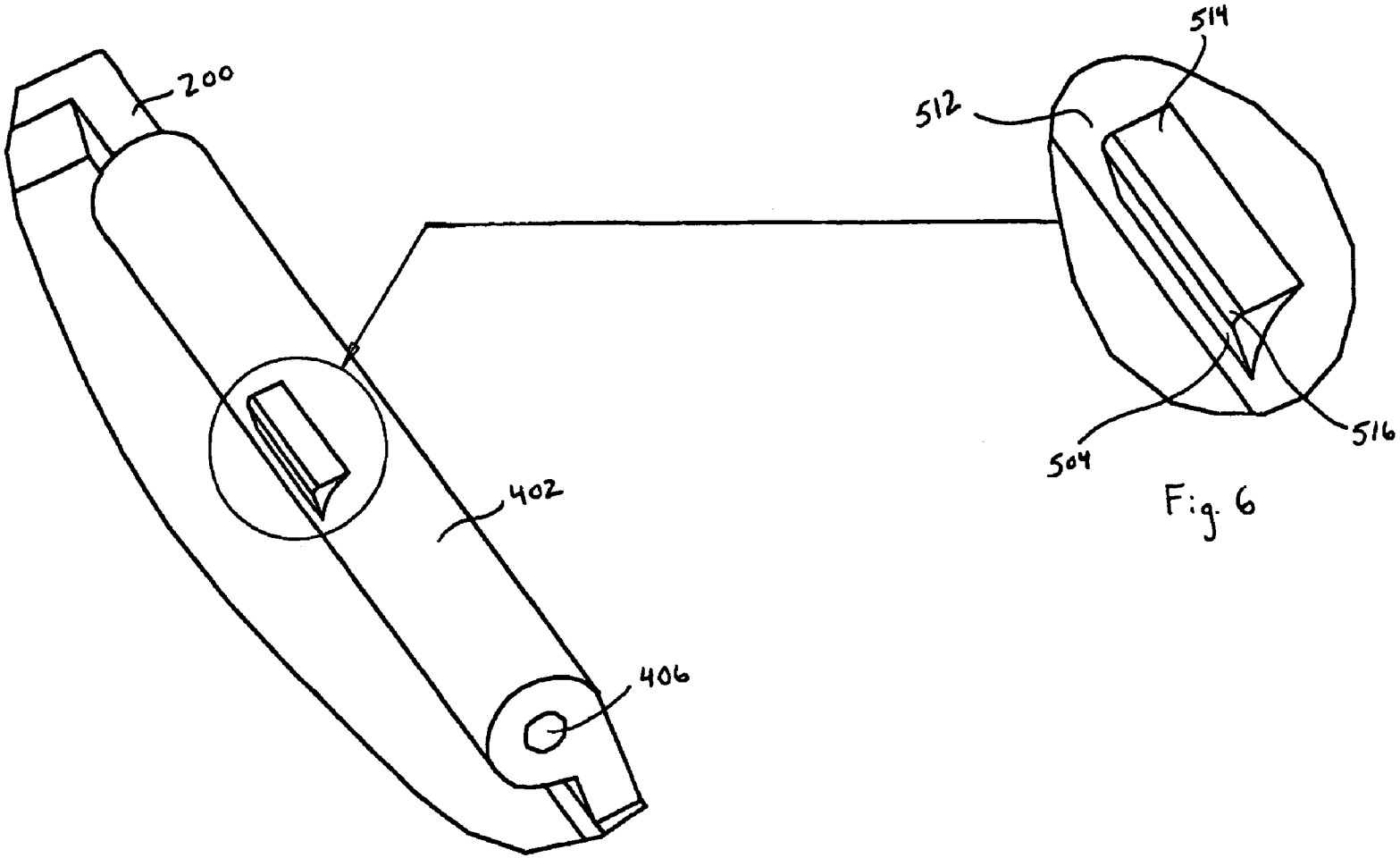
FIG. 5 is a more detailed bottom perspective view of a schematic drawing of a portion of the container system of FIG. 1.
FIG. 6 is a more detailed bottom perspective view of a schematic drawing of the portion of FIG. 5.

Referring to FIGS. 4 through 6, the first cam surface 504 is shown as being supported by the cover portion 200. According to an exemplary embodiment, the first cam surface 504 is provided on a projection 512 which outwardly extends from the first sleeve 402 of the hinge mechanism 400. The projection 512 is preferably integrally formed with the first sleeve 402, but alternatively, may be provided as a separate component that is subsequently coupled to the first sleeve 402. Referring particularly to FIG. 6, the projection 512 not only defines the first cam surface 504, but also a second cam surface 514. The second cam surface 514 assists in an opening operation of the container 100 (i.e., the moving of the cover portion 200 from the closed position to the open position) and is configured to engage the spring element 502 when the cover portion 200 has pivoted a predetermined angle anyway from the base portion 300. The spring element 502 acting on the second cam surface 514 creates an opening torque on the cover portion 200 thereby causing the cover portion 200 to move anyway from the base portion 300.

The first cam surface 504 and the second cam surface 514 are shown as being substantially linear surfaces. According to various alternative embodiments, the first cam surface 504 and the second cam surface 514 may include curvilinear portions depending on various design criteria. Separating the first cam surface 504 from the second cam surface 514 is a peak surface 516. The peak surface 516 is preferably rounded or otherwise curved to provide a relatively smooth transition between the first cam surface 504 and the second cam surface 514.

Referring back to FIGS. 1 and 2, the closer mechanism 500 is substantially concealed (e.g., hidden, etc.) when the container 100 is in the closed position or in the open position. While portions of the closer mechanism 500 may be visible from the bottom of the container 100 (shown in FIG. 7), the closer mechanism 500 is relatively nonintrusive in comparison to conventional latch mechanism provided at the front of known containers. According to an exemplary embodiment, the closer mechanism 500 is substantially concealed by the deck portion 318. The deck portion 318 also functions to trap the spring element 502 within the channels 510. According to various alternative embodiments, the closer mechanism 500 may be concealed by other portions of the container 100 (e.g., the peripheral side walls of the base portion and/or the cover portion, etc.).

Figure 8A:
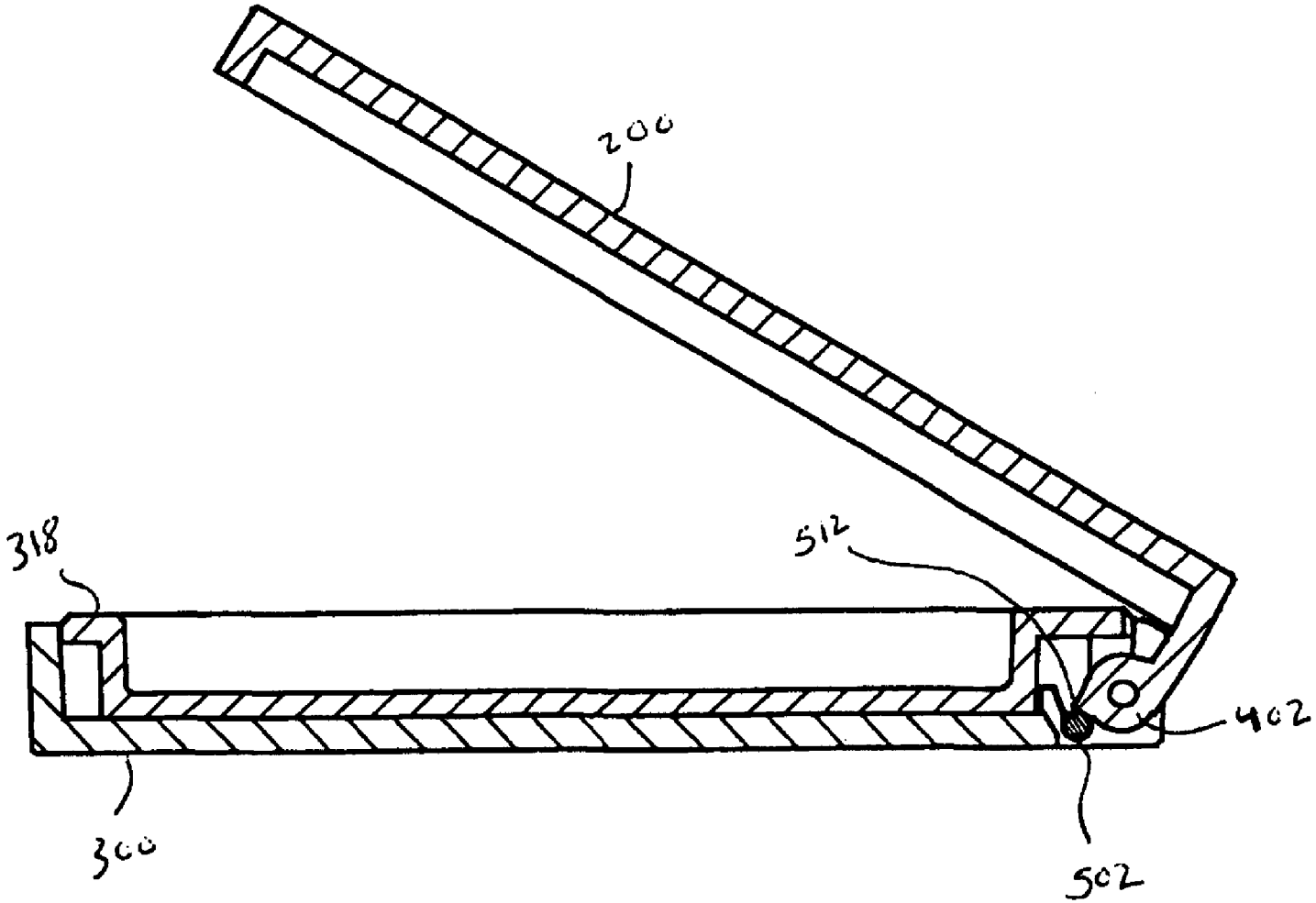
FIGS. 8*a* through 8*c* are cross-sectional views of a schematic drawings of the container system along a line 8-8 of FIG. 1 showing sequentially the movement of the container system between the open position and the closed position.
Figure 8A:
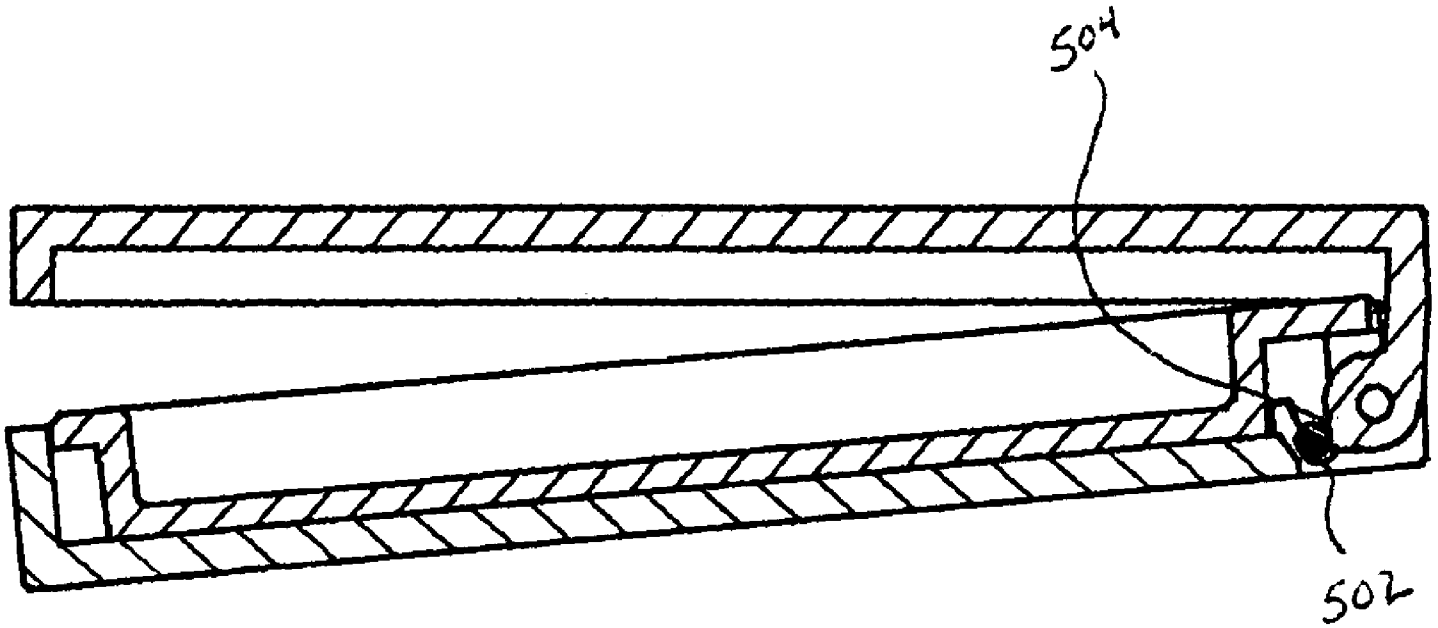
Figure 8I:
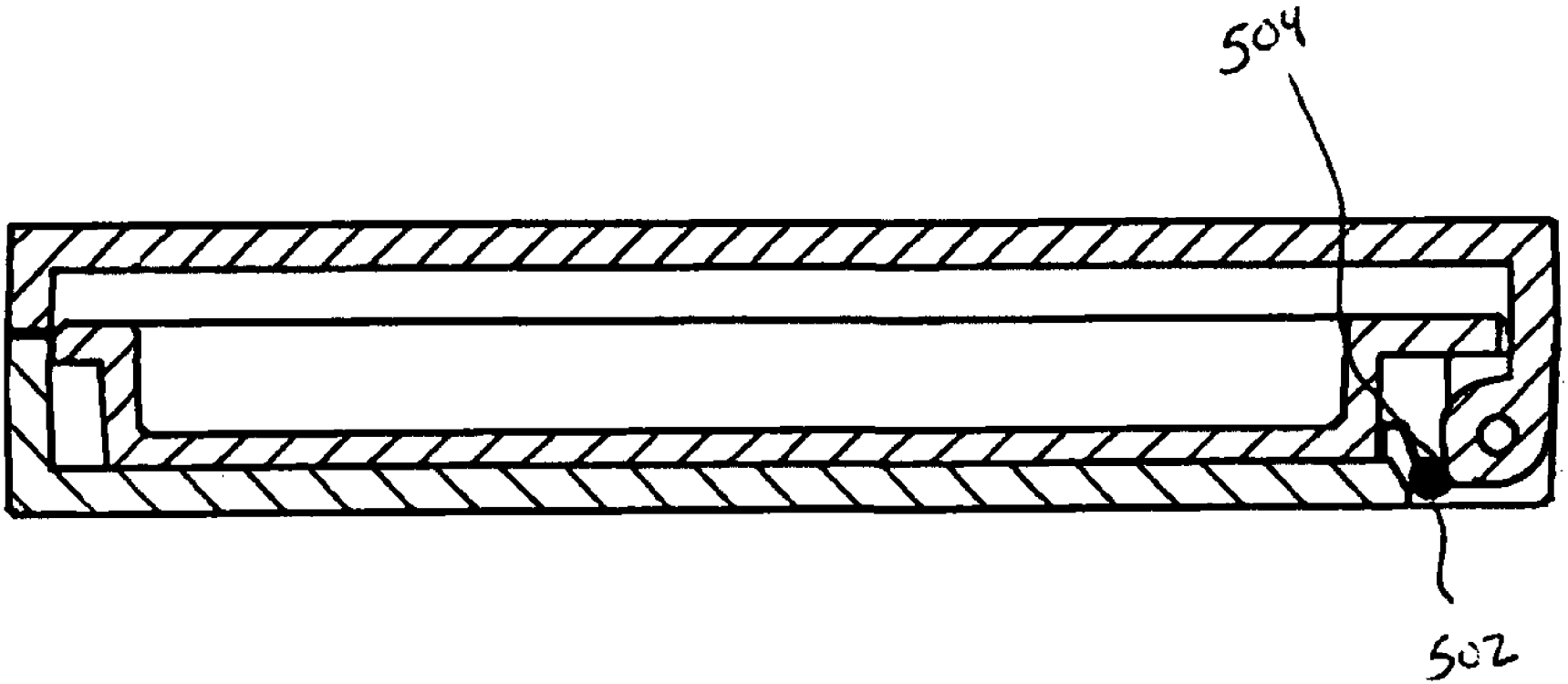

With reference to FIGS. 8*a* through 8*c*, the closing operation of the container 100 will be described. FIG. 8*a* is a cross-sectional view showing the container 100 in an at least partially open position. In this position, a user may selectively access an article stowed within the container 100. It should be noted that the cover portion 200 may be configured to rotate to any of a variety of angles relative to the base portion 300. To close the container 100, a user selectively rotates the cover portion 200 about the hinge mechanism 400 towards the base portion 300. Referring to FIG. 8*b*, once the cover portion 200 achieves a predetermined angle relative to the base portion 300, the peak surface 516 and subsequently the first cam surface 504 engage the spring element 502.

The angle between the cover portion 200 and the base portion 300 at which the first cam surface 504 will engage the spring element 502 may vary depending on various design criteria. According to an exemplary embodiment, the first cam surface 504 will first engage the spring element 502 when the cover portion 200 is at an angle between approximately 60 degrees and approximately 5 degrees relative to the base portion 300. According to a preferred embodiment, the first cam surface 504 will first engage the spring element 502 when the cover portion 200 is at an angle between approximately 45 degrees and approximately 20 degrees. According to various alternative embodiments, the first cam surface 504 may first engage the spring element 502 when the cover portion 200 is at an angle greater than or less than the angles provided above.

Figure 7:
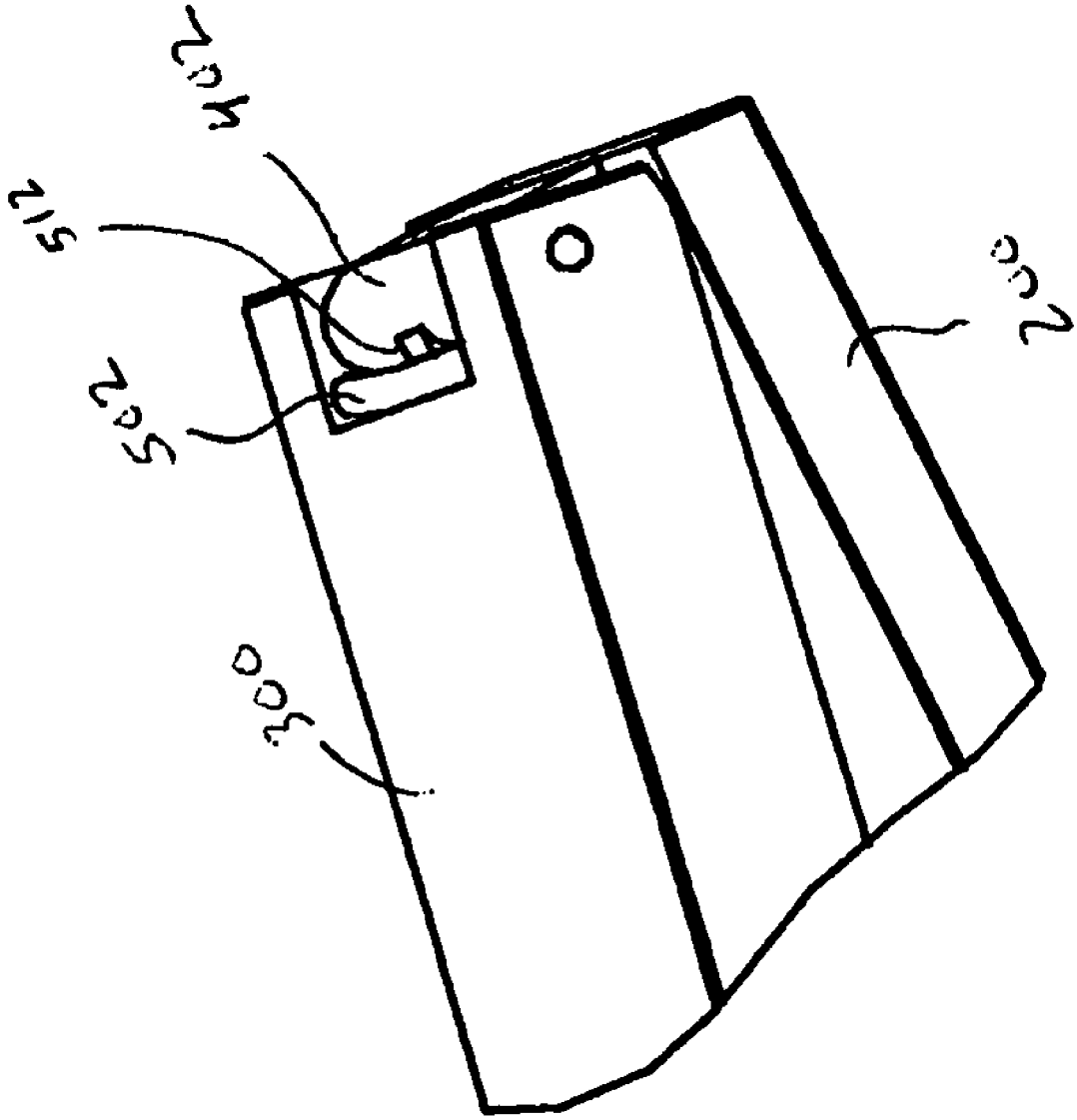
FIG. 7 is a more detailed bottom perspective view of a schematic drawing of the container system of FIG. 1.

When the peak surface 516 and the first cam surface 504 engage the spring element 502, the spring element 502 is deflected (shown in FIG. 7). The spring element 502 acting on the first cam surface 504 creates a closing torque on the cover portion 200 thereby causing the cover portion 200 to move towards the base portion 300 without further assistance by the user. Referring to FIG. 8*c*, once in the closed position, the spring element 502 acting on the first cam surface 504 at least partially retains the cover portion 200 in the closed position.

The opening operation is substantially the inverse of the closing operation. A user selectively actuates the cover portion 200 by lifting up with a force sufficient to overcome the force exerted by the spring element 502 acting on the first cam surface 504. Once the cover portion 200 achieves a predetermined angle relative to the base portion 300, the peak surface 516 and subsequently the second surface 514 engage the spring element 502.

The angle between the cover portion 200 and the base portion 300 at which the second cam surface 514 will engage the spring element 502 may vary depending on various design criteria. According to an exemplary embodiment, the second cam surface 514 will first engage the spring element 502 when the cover portion 200 is at an angle between approximately 5 degrees and approximately 60 degrees relative to the base portion 300. According to a preferred embodiment, the second cam surface 514 will first engage the spring element 502 when the cover portion 200 is at an angle between approximately 10 degrees and approximately 30 degrees. According to various alternative embodiments, the second cam surface 514 may first engage the spring element 502 when the cover portion 200 is at an angle greater than or less than the angles provided above.

When the peak surface 516 and the second cam surface 514 engage the spring element 502, the spring element 502 is deflected. The spring element 502 acting on the second cam surface 514 creates an opening torque on the cover portion 200 thereby causing the cover portion 200 to move away the base portion 300 without further assistance by the user.

FIGS. 9 through 12 show a container system according to another exemplary embodiment. The container system of FIGS. 9 through 12 is shown as a container 1100. For brevity, the description of the container 1100 will generally be limited to its differences relative to the container 100 described above. For convenience, elements of container 1100 that are substantially similar to corresponding elements of the container 100 will be identified by the same reference numerals but preceded by a "1."

The container 1100 differs from the container 100 described above in that the cover portion 1200 and the base portion 1300 cooperate to provide a substantially round or circular container rather than a rectangular container as described above. The container 1100 also differs from the container 100 described above in that the spring element 1502 has a curvilinear or arcuate shape complimentary to the shape of the peripheral sidewall 1304 of the base portion 1300. The closing and opening operations of the container 1100 is substantially similar to that of the container 100.

It is important to note that the construction and arrangement of the elements of the container systems as shown in the exemplary embodiments are illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Further, the container may be configured in a wide variety of shapes to accommodate varying design criteria. According to various alternative embodiments, the container may be configured into other sizes, as well as other well-known or otherwise suitable shapes having linear and/or nonlinear edges and surfaces. Further, for purposes of this disclosure the term "cosmetic substance" is used broadly to refer to any substance (e.g., press-powder, loss powder, cream, gel, liquid, wax, etc.) including, but not limited to lip gloss, eye shadow, face powder, etc. According to various other exemplary embodiments, the container may be configured to support a supplemental or secondary latch mechanism provided that the front of the container.

Accordingly, all such modifications are intended to be included within the scope of the appended claims. The order or sequence of any process or method steps may be varied or re-sequenced according to alternative embodiments. Other substitutions, modifications, changes and omissions may be made in the design, operating conditions and arrangement of the various exemplary embodiments without departing from the scope of the appended claims.

What is claimed is:

1. A container having a front portion and a rear portion, the container comprising:

a base;

a cover coupled to base about a hinge;

a resilient bar having a first end, a second end and a central portion between the first end and the second end, the first end and the second end being supported at one of the base and the cover, the central portion being unsupported;

a first cam surface supported at the other one of the base and the cover, the first cam surface engages the central portion of the resilient bar when the cover has moved a predetermined angle relative to the base and deflects the central portion of the resilient bar toward the front portion of the container, wherein the resilient bar acting on the first cam surface moves the cover to a closed position; and a second cam surface supported at the other one of the base and the cover, the second cam surface configured to engage the resilient bar when the cover has pivoted a predetermined angle relative to the base for moving the cover to an open position.

2. The container of claim 1 wherein the resilient bar extends substantially parallel to a rotational axis of the hinge between the first end and the second end.

3. The container of claim 2 wherein movement of the first end and the second end is restricted in a direction substantially perpendicular to the rotational axis of the hinge.

4. The container of claim 3 wherein the first end and the second end are each supported in channels that restrict the first end and the second end from moving in a direction toward the front of the container.

5. The container of claim 1 wherein resilient bar and the hinge are both provided at the rear portion of the container.

6. The container of claim 5 wherein the resilient bar is a substantially straight member.

7. The container of claim 5 wherein the resilient bar has an arcuate shape complimentary to the rear portion of the container.

8. The container of claim 1 wherein a closing torque is first applied to the cover by the resilient bar acting on the first cam surface when the cover is at an angle between approximately 60 degrees and approximately 5 degrees relative to the base.

9. The container of claim 1 wherein an opening torque is first applied to the cover by the resilient bar acting on the second cam surface when the cover is at an angle between approximately 5 degrees and approximately 60 degrees relative to the base.

10. The container of claim 1 further comprising a projection supported on the hinge, the projection defining the first cam surface.

11. The container of claim 10 wherein the hinge comprises a first hinge component supported at the cover and a second hinge component supported at the base.

12. The container of claim 11 wherein the first hinge component is integrally formed with the cover and the second hinge component is integrally formed with the base.

13. The container of claim 12 wherein the first hinge component is a sleeve configured to support the projection.

14. The container of claim 13 further comprising a deck configured to be supported by the base, the deck includes at least one cavity configured to support a cosmetic article, the deck conceals a top portion of the resilient bar when cover is open relative to the base.

15. The container of claim 1 wherein the base is substantially circular in shape and comprises a sidewall defining an outer periphery of the base, the resilient bar being supported at the base and having substantially the same shape as the sidewall.

16. A cosmetic container comprising:

a base;

a deck supported by the base and defining at least one cavity;

a cosmetic substance supported within the cavity;

a cover coupled to the base about a hinge, the cover is configured to move between an open position and a closed position relative to the base;

a resilient member having a first end, a second end and a central portion between the first end and the second end, the first end and the second end being supported at one of the base and the cover, the central portion being unsupported;

a first cam surface that engages the central portion of the resilient member and deflects the central portion of the resilient member toward a front portion of the cosmetic container for moving the cover to the closed position; and a second cam surface configured to engage the resilient member for moving the cover to the open position, wherein the deck conceals the resilient member within an interior of the container when the cover is in the open position.

17. The cosmetic container of claim 16 wherein the resilient member acting on the first cam surface assists in maintaining the cover in the closed position.

18. The cosmetic container of claim 16 wherein the first cam surface and the second cam surface are supported on the hinge.

19. The cosmetic container of claim 16 wherein the base is substantially circular in shape and comprises a sidewall defining an outer periphery of the base, the resilient member being supported at the base and having substantially the same shape as the sidewall.

20. The cosmetic container of claim 16 wherein the first end and the second end are each supported in channels that restrict the first end and the second end from moving in a direction toward the front of the container.

* * * * *

UNITED STATES PATENT AND TRADEMARK OFFICE

CERTIFICATE OF CORRECTION

PATENT NO. : 7,604,142 B2
APPLICATION NO. : 11/297798
DATED : October 20, 2009
INVENTOR(S) : Joachim Banik It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 909 days.

Signed and Sealed this

Fifth Day of October, 2010

David J. Kappos

David J. Kappos
*Director of the United States Patent and Trademark Office*